United States Patent [19]

Morris

[11] 4,234,089

[45] Nov. 18, 1980

[54] MICROFICHE TRAY

[76] Inventor: Royden B. Morris, 940 11th Ave. SW., Calgary, Alberta, Canada

[21] Appl. No.: 6,807

[22] Filed: Jan. 25, 1979

[30] Foreign Application Priority Data

Jan. 26, 1978 [CA] Canada ..... 295745

[51] Int. Cl.[3] ..... B65D 85/48

[52] U.S. Cl. ..... 206/456; 206/561; 220/22

[58] Field of Search ..... 206/561, 564, 455, 456; 220/22, 22.3

[56] References Cited

U.S. PATENT DOCUMENTS

| | | | |
|---|---|---|---|
| 1,163,373 | 11/1915 | Schmidt | 220/22.3 |
| 1,523,136 | 1/1925 | O'Connor | 220/22.3 |
| 1,712,177 | 5/1929 | Duthie-Strachan | 220/22 |
| 2,012,035 | 8/1935 | Clark | 220/22.3 |
| 2,221,024 | 11/1940 | Hood | 206/561 X |
| 2,247,593 | 7/1941 | Weber | 206/425 |
| 3,554,429 | 1/1971 | Cohen | 206/456 |
| 4,126,261 | 11/1978 | Cook | 206/561 X |

*Primary Examiner*—Joseph M. Moy

*Attorney, Agent, or Firm*—Larson, Taylor and Hinds

[57] ABSTRACT

A tray for microfiche or other flat articles includes a flat rectangular base, with side and end wall extending upwardly and slightly outwardly therefrom, the side walls having vertical upper ends and shoulders for receiving side bars. The side bars are provided with vertical and inclined, parallel slots for receiving partitions, whereby the microfiche can be stored vertically in parallel relationship to each other or fan-like, i.e. with the bottom ends of the microfiche closer together than their top ends for easier inspection.

4 Claims, 2 Drawing Figures

MICROFICHE TRAY

BACKGROUND OF THE INVENTION

This invention relates to a tray for holding planar, rectangular articles and, in particular, to a microfich tray.

In general, presently available trays for microfiche transparencies include partitions, which are usually rectangular and loosely fitted in the tray. The problems with such an arrangement are that there is no firm separation between groups of microfiche transparencies (hereinafter simply referred to as microfiche cards), and the microfiche cards can only be stored in the vertical position.

U.S. Pat. Nos. 1,939,651, which issued to J. E. Bales on Dec. 19, 1933; 2,459,561, which issued to H. H. Yawman on Jan. 18, 1949; and 2,586,925 which issued to V. Drengberg on Feb. 26, 1952 disclose a variety of trays or boxes for flat, rectangular articles which could be used to carry microfiche cards. However, such trays suffer from at least one of the drawbacks mentioned above, namely that the microfiche cards can be stored in the vertical position only. Because microfiche cards are relatively thin, there should be the option of storing such cards in a fan-like manner, i.e. with the bottom ends of the cards close together while the top ends are spaced slightly apart for easy accessibility.

OBJECTS OF THE INVENTION

The object of the present invention is to provide a tray for microfiche cards or other flat articles which is relatively simply in construction, with interchangeable elements, and which provides the option of vertical or fan-like storage of the cards.

SUMMARY OF THE INVENTION

Accordingly, the invention relates to a tray for microfiche cards or other flat articles comprising a bottom wall; side and end walls substantially at right angles to each other extending upwardly from said bottom wall, each of said side walls including a lower portion, an upper portion and a substantially horizontal shoulder between said lower and upper portions, the tray being wider between said upper portions than between said lower portions of the side walls; a side bar for removable mounting on said shoulder on each side of the tray; and a plurality of vertical and inclined slots on the interior surface of each side bar for receiving and retaining partitions extending between the sides of the tray, whereby the partitions can be vertically positioned in parallel relationship to each other or inclined relative to each other.

More specifically, the invention relates to a tray for microfiche cards or other flat articles comprising a bottom wall, side and end walls substantially at right angles to each other extending upwardly from said bottom wall, said side walls including a lower portion inclined outwardly and upwardly from a plane extending longitudinally of the tray and perpendicular to the bottom wall, a vertical top portion parallel to said plane, and an interior substantially horizontal shoulder between said top and bottom portions of each side wall, the tray being wider between said upper portions than between said lower portions; a side bar for removable mounting on said shoulder on each side of said tray; a plurality of vertical and inclined slots in each said side bar for receiving and retaining partitions extending between the sides of the tray, whereby the partitions can be vertically positioned in parallel relationship to each other, or inclined relative to each other; and means for releasably retaining each said side bar on said shoulder.

The use of side bars with inclined slots permits the storage of microfiche cards in any desired manner, namely vertically in parallel relationship to each other, inclined to the vertical or fan-like.

DESCRIPTION OF THE DRAWINGS

The invention will now be described in greater detail with reference to the accompanying drawings, which illustrate a preferred embodiment of the invention, and wherein.

DESCRIPTION OF THE INVENTION

Figure 1:
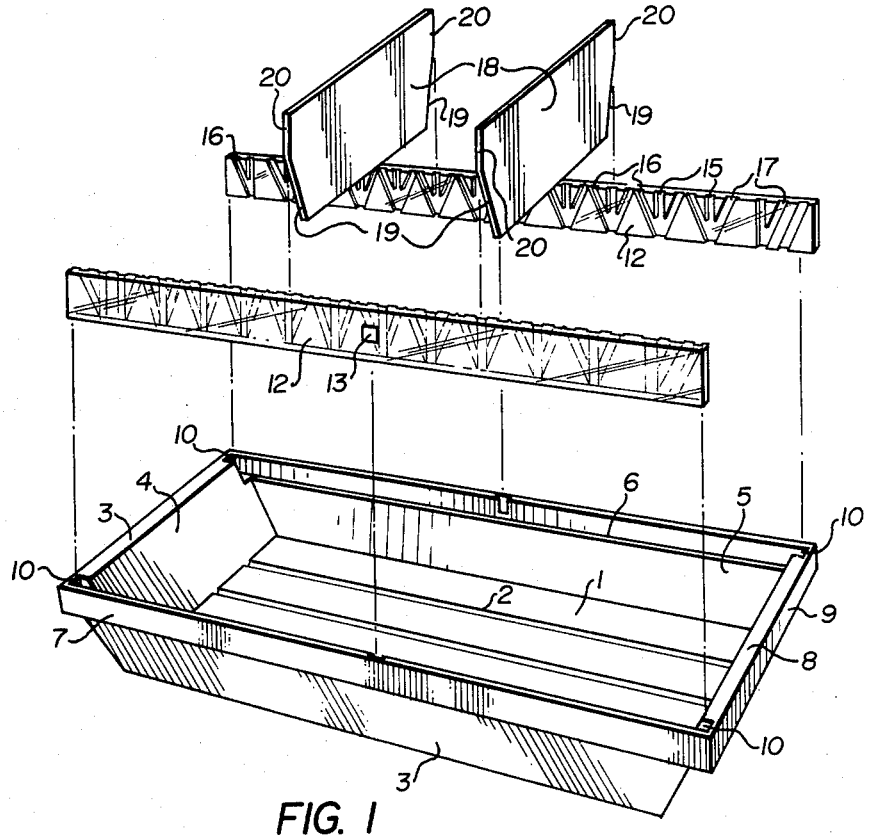
FIG. 1 is an exploded, perspective view of a tray in accordance with the present invention.
Figure 2:
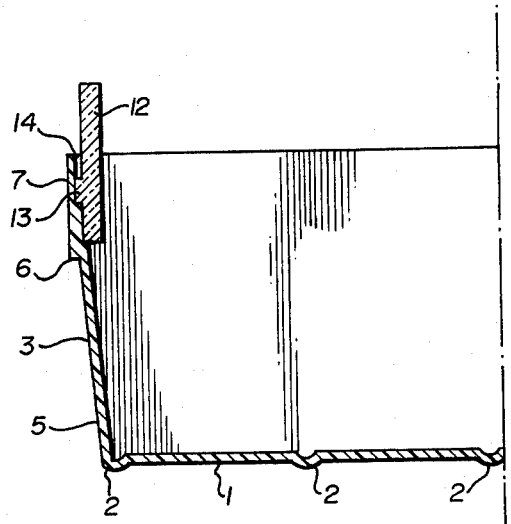
FIG. 2 is a cross-sectional view of the tray of FIG. 1 taken at the centre thereof.

With reference to the drawings, the tray of the present invention is a molded structure including a bottom wall 1 with integral, longitudinally extending feet 2. Side and end walls 3 and 4, respectively extend upwardly from the sides and ends of the bottom wall 1. The side walls 3 are inclined outwardly at an angle of approximately 5° to the vertical. Each side wall 3 includes an outwardly inclined bottom portion 5 (FIG. 2), a horizontal shoulder 6 and a vertical top portion 7. The end walls 4 are inclined outwardly at an angle of approximately 20° to the vertical, and extend between the ends of the side walls 3. Each end wall is molded with a flat top ledge 8 and an exterior, vertical overhang 9. Rectangular slots 10 are provided in the end walls 3 at each corner of the tray for receiving ends 11 of a pair of side bars 12. The slots 10 open into the tray and are closed at their bottom ends by a base (not shown). The base is located at the same level as the shoulders 6.

Each side bar 12 is a thin, elongated, rectangular parallelepipedic strip of plastic, the ends of which slide into and are retained by the slots 10. A projection 13 is provided on the centre of the exterior surface on each side bar 12 for mating with a vertical slot 14 in the centre of the top portion 7 of each side wall 3. The projection 13 is wider at its outer end than at its inner end, and the reverse is true of the slot 14, so that the result is a dovetail joint. The projection 13 and slot 14 constitute locking means for preventing bowing of the side bars at their centres.

The interior surface of each side bar 12 is provided with a plurality of vertical slots 15 spaced equidistant apart along the length of the side bar, and inclined slots 16 and 17 (inclined at approximately 20° to the vertical like the end walls 4) also spaced equidistant apart along the length of the side bars. The slots 16 slope in one direction and the slots 19 in the opposite direction. The slots 15, 16 and 17 are intended to hold partitions 18 which extend between the sides of the tray. The partitions 18 are planar with downwardly and inwardly inclined side edges 19. A rectangular arm 20 extends outwardly from the top of each side edge 19 for mating with opposing slots 15, 16 or 17 in the side bars 12.

The tray, side bars and partitions are preferably made of plastic, but of course, other materials could be used. When not in use, the trays can be nested for storage. When the trays are in use, one tray can be inverted and placed on a microfiche-containing tray to act as a cover. For carrying 4"×6" microfiche, typical dimensions of the tray are an overall length at the top of 15¾", a bottom length of 13½", a top width of 6 7/16", a bottom width inside the tray of 6", and a height of 2 3/7", the side bars being 1 3/16" high and 5/32" thick.

In use, with the side bars 12 in position, the interior surface of the side bars are located in a vertical plane which, if extended, would intersect the bottom portion 5 of the side wall 3 above the bottom wall 1 of the tray. Thus, the side bars 12 do not interfere with the microfiche cards. The partitions 18 are inserted in the slots 15, 16 and/or 17 of the side bars 12 depending on the desired type of storage. If the partitions 18 are placed in parallal vertical slots 15, the microfiche cards are stored vertically, parallel to each other. When the two partitions are placed in inclined, spaced apart slots 16 and 17 the microfiche cards are stored in a fan-like manner, i.e. with their bottom ends close together and their top ends farther apart for easier viewing.

It will be appreciated that the dimensions of the tray are not critical, being dictated soley by the dimensions of the articles to be stored therein. Moreover, the angles of inclination of the side and end walls, and slots in the side bars are also not critical, the structure described hereinbefore merely being the preferred one.

What is claimed is:

1. A tray for microfiche cards or other flat articles comprising a bottom wall; side and end walls substantially at right angles to each other extending upwardly from said bottom wall, each of said side walls including a lower portion, an upper portion, and a substantially horizontal shoulder extending outwardly of said side wall at said upper portion, the tray being wider between said upper portions than between said lower portions of the side walls; a side bar for removable mounting on said shoulder on each side of the tray; retaining means for releasably retaining said side bars on said shoulder on each side of said tray; and a plurality of vertical and inclined slots on the interior surface of each side bar for receiving and retaining partitions extending between the sides of the tray, whereby the partitions can be vertically positioned in parallel relationship to each other or inclined relative to each other.

2. A tray according to claim 1, wherein said lower portion of each said side wall is inclined outwardly and upwardly relative to a vertical plane extending longitudinally of the tray and perpendicular to the bottom wall, and said top portion is parallel to said plane.

3. A tray according to claim 2, wherein said retaining means includes a slot in the top end of said end wall at the junction between a side and end wall for receiving an end of said side bar and a dovetail joint between the centre of each side side bar and the upper portion of a side wall.

4. A tray according to claim 1, 2 or 3, wherein said end walls are inclined upwardly and outwardly at the same angle of inclination as the inclined slots in said side bars.

* * * * *